US009049819B2

(12) United States Patent
Chang

(10) Patent No.: US 9,049,819 B2
(45) Date of Patent: Jun. 9, 2015

(54) STRUCTURE FOR REINFORCING GREENING MEMBER AND CONSTRUCTION METHOD THEREOF

(76) Inventor: Yushun Chang, Richmond (CA)

( * ) Notice: Subject to any disclaimer, the term of this patent is extended or adjusted under 35 U.S.C. 154(b) by 188 days.

(21) Appl. No.: 13/703,980

(22) PCT Filed: Jun. 13, 2010

(86) PCT No.: PCT/CN2010/073927

§ 371 (c)(1),
(2), (4) Date: Jan. 31, 2013

(87) PCT Pub. No.: WO2011/156950

PCT Pub. Date: Dec. 22, 2011

(65) Prior Publication Data

US 2013/0125458 A1 May 23, 2013

(51) Int. Cl.

| | |
|---|---|
| ***A01C 1/00*** | (2006.01) |
| ***E02D 17/20*** | (2006.01) |
| ***A01G 1/00*** | (2006.01) |

(52) U.S. Cl.
CPC . *A01G 1/00* (2013.01); *E02D 17/20* (2013.01)

(58) Field of Classification Search
USPC ..... 47/1.01 F, 20.1, 22.1, 31, 31.1, 41.14, 47/42; 405/302.6, 302.7
See application file for complete search history.

(56) References Cited

U.S. PATENT DOCUMENTS

| | | | | |
|---|---|---|---|---|
| 2,102,748 | A * | 12/1937 | Rocquin | 47/1.01 R |
| 5,175,966 | A * | 1/1993 | Remke et al. | 52/163 |
| 6,951,438 | B2 * | 10/2005 | Carpenter | 405/302.6 |
| 7,555,862 | B2 * | 7/2009 | Li | 47/31 |
| 7,695,219 | B2 * | 4/2010 | Carpenter | 405/302.6 |
| 7,789,594 | B2 * | 9/2010 | Stahm | 405/302.4 |
| 7,828,499 | B2 * | 11/2010 | Carpenter | 405/302.6 |
| 7,862,259 | B2 * | 1/2011 | Carpenter | 405/302.7 |
| 7,950,878 | B2 * | 5/2011 | Carpenter | 405/302.6 |
| 8,157,482 | B2 * | 4/2012 | Carpenter et al. | 405/259.1 |
| 8,651,771 | B2 * | 2/2014 | Schneider et al. | 405/302.7 |
| 2008/0034682 | A1 * | 2/2008 | Carpenter | 52/155 |
| 2009/0016826 | A1 * | 1/2009 | Carpenter | 405/302.6 |
| 2009/0041548 | A1 * | 2/2009 | Stahm | 405/259.1 |
| 2012/0045286 | A1 * | 2/2012 | Oliveira | 405/302.7 |

FOREIGN PATENT DOCUMENTS

| | | | |
|---|---|---|---|
| CN | 101507391 | A | 8/2009 |
| CN | 101761064 | A | 6/2010 |
| CN | 201663824 | U | 12/2010 |
| JP | 2007-146540 | A | 6/2007 |
| KR | 20-0442634 | Y1 | 11/2008 |
| KR | 10-2009-0074310 | A | 7/2009 |
| KR | 10-0918195 | B1 | 9/2009 |
| WO | 2007/027041 | A1 | 3/2007 |

* cited by examiner

*Primary Examiner* — Kristen C Hayes
(74) *Attorney, Agent, or Firm* — Terrence J. Edwards; TechLaw Ventures, PLLC

(57) ABSTRACT

A structure for reinforcing a greening member and a construction method thereof are provided. The structure for reinforcing a greening member comprises a greening member adapted for being placed on a surface of an area to be greened, a positioning cover (2), a positioning member (3) and a rope (4). The positioning member is adapted to be inserted into the ground of the area to be greened. A positioning member is provided with a pivot portion (31). One end of the rope is fixedly connected to the pivot portion, and the other end is exposed out of the ground of the area to be greened and passes through the greening member to reach the positioning cover. The other end of the rope is fixed by the positioning cover.

7 Claims, 8 Drawing Sheets

STRUCTURE FOR REINFORCING GREENING MEMBER AND CONSTRUCTION METHOD THEREOF

FIELD OF THE INVENTION

The present invention relates to a structure for reinforcing a greening member and a construction method thereof, which is suitable for the greening of the desert, a soil slope, and so on.

BACKGROUND OF THE INVENTION

With the increasing public attention to the ecological environment issues, the greening of areas such as the desert, a slope and a river bank receive more and more social attention. The greening may be implemented in various manners, such as by means of a net, by means of placing fabrics, and by means of the stack of vegetation bags. The greening members used in these manners, such as the net, the fabrics and the vegetation bag, are mostly fastened on the surface of an afforesting area (i.e. an area to be afforested) through anchoring rods, which, if inserted into soil or deserts, may be loosened after a period of time due to the decreased friction force between the anchoring rod and the soil or deserts, and may be even drawn out, as a result, the greening members would be displaced due to such loosening, leading to a failure of the greening. Therefore, the fastening manner by means of the anchoring rod is unreliable and is not optimal for the greening.

SUMMARY OF THE INVENTION

In view of the drawbacks in the prior art mentioned about, an object of the present invention is to provide a structure for reinforcing a greening member and a construction method thereof, which are advantageous for an improved, effect of fastening.

To achieve the above object, the following technical solutions of the present invention are provided.

A structure for reinforcing a greening member includes: a greening member adapted for being placed on a surface of an afforesting area; a positioning cover adapted for pressing on the greening member; a positioning member provided with a pivot portion, which is adapted for being inserted into the ground of the afforesting area; and a rope, one end of which is fastened to the pivot portion, and the other end of which is extended out from the ground of the afforesting area and extended through the greening member to the positioning cover, where the other end of the rope is fixed by the positioning cover, so that the rope is tensioned between the positioning cover and the positioning member, with the positioning cover pressing on the greening member.

The positioning cover may include a cover body and a locking sleeve, the cover body is provided with a through hole, the locking sleeve rests against a periphery of the through hole of the cover body, and the rope is extended through the hole and locked by the locking sleeve.

The positioning member may include a positioning body which is provided with a longitudinal aperture, and the pivot portion is arranged on the periphery (i.e. an outer surface) of the positioning body.

A longitudinal ridge is extended from the periphery of the positioning body, and the longitudinal ridge is provided with a through hole, which functions as the pivot portion and to which one end of the rope is fastened.

A pair of lateral wings are symmetrically provided at both lateral sides of the positioning body.

A platform is provided at the periphery of the positioning body, and a cone-shaped stopper is longitudinally provided on the platform upwards.

A reinforcing layer adhering to the positioning member is provided between the positioning member and the surface of the afforesting area.

The greening member is an ecological fabric, an ecological bag, a planting bag, or a greening grid; the positioning member is made of metal or plastic; and the rope is a steel wire, an iron wire or a plastic rope.

A method for constructing the structure for reinforcing a greening member includes steps of:

(1) fastening one end of the rope to the pivot portion of the positioning member;

(2) inserting the positioning member into the ground of the afforesting area by a predetermined depth through a tool, with the rope being partially extended to the ground of the afforesting area along with the positioning member, and a portion of the rope being extended out from the ground of the area;

(3) pulling the rope outwards so that the positioning member is rotated about the pivot portion in the ground of the area by an angle;

(4) placing the greening member on the surface of the afforesting area; and (5) passing the portion of the rope extended, out from the ground of the area through the greening member and fastening the portion of the rope to the positioning cover, so that the rope is tensioned between the positioning cover and the positioning member, with the positioning cover pressing on the greening member, allowing the greening member to be fixed on the surface of the afforesting area.

Further, a hollow pipe for injecting adhesive is attached to the tool, and one end of the hollow pipe is stuffed by a preset stopper on the positioning member, when the positioning member is inserted into the ground of the afforesting area by a tool, the hollow pipe is partially extended into the ground of the afforesting area along with the tool, and then the tool is drawn back by a distance so that the hollow pipe is separated from the stopper of the positioning member; then the rope is drawn outwards, and in the process of rotating the positioning member or when the rotating of the positioning member is stopped, adhesive is injected into the hollow pipe and penetrates the ground of the afforesting area, so that the positioning member is further fastened to the afforesting area.

The present invention is advantageous as follow. The positioning member inserted into the ground of the afforesting area may be rotated to be more firmly fixed by the increased resistance that is applied by the ground of the afforesting area to the positioning member, and the positioning cover is further fastened by the rope so that the positioning cover presses tightly on the greening member. In this case, the positioning member inserted into the ground of the afforesting area can be fully fixed without being loosened, thus the greening member can be firmly located on the ground of the afforesting area, thereby achieving an improved effect of fastening. Thus, the shortcoming of fastening the greening members by means of the anchoring rod in the prior art can be overcome, for the purpose of market promotion.

REFERENCE NUMERAL LIST

| | |
|---|---|
| 1: Afforesting area | 2: Positioning cover |
| 21: Cover body | 22: Locking sleeve |
| 3: Positioning member | 31: Pivot portion |
| 32: Positioning body | 321: Longitudinal aperture |
| 33: Longitudinal ridge | 34: Lateral wing |
| 35: Platform | 351: Stopper |
| 4: Rope | 5: Net or ecological fabric |
| 6: Greening material | 7: Reinforcing layer |
| 8: Hollow pipe | |

DETAILED DESCRIPTION OF PREFERRED EMBODIMENTS

The present invention is described below with reference to the attached drawings and embodiments.

Figure 1:
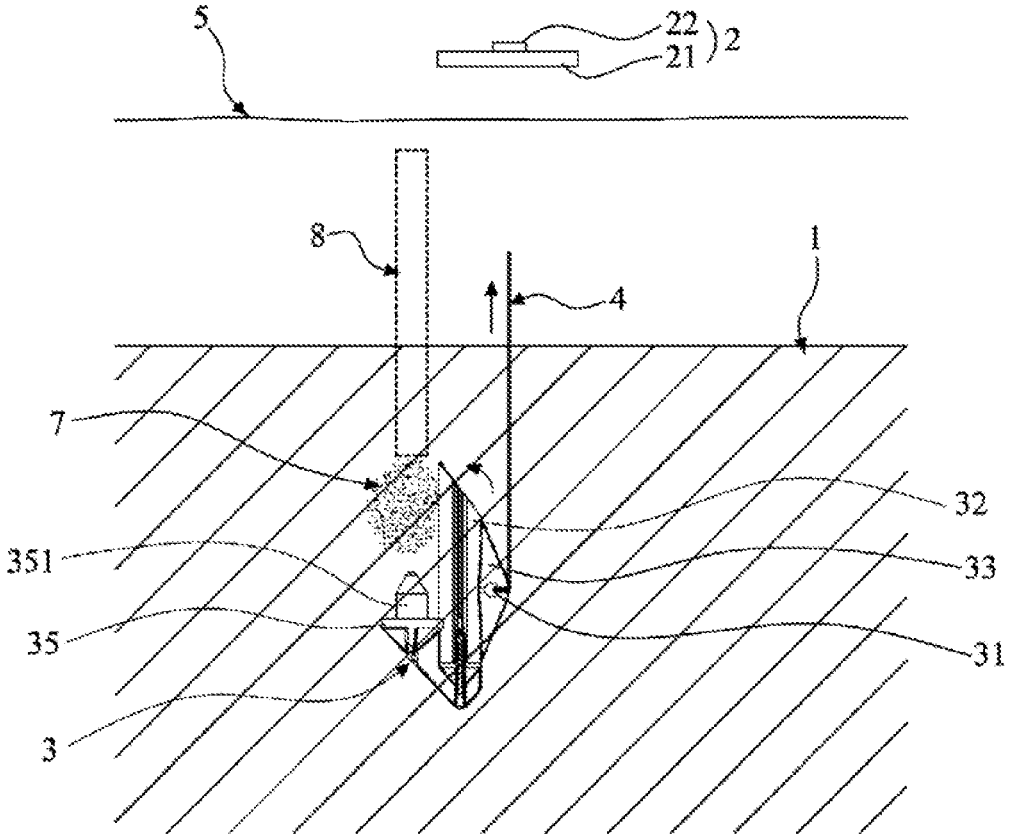
FIG. 1 schematically shows a first embodiment of the invention, which may be applicable to a soil area to be afforested, in a state where the positioning member is inserted into the ground of the area for fastening a greening member such as a net or an ecological fabric.
Figure 2:
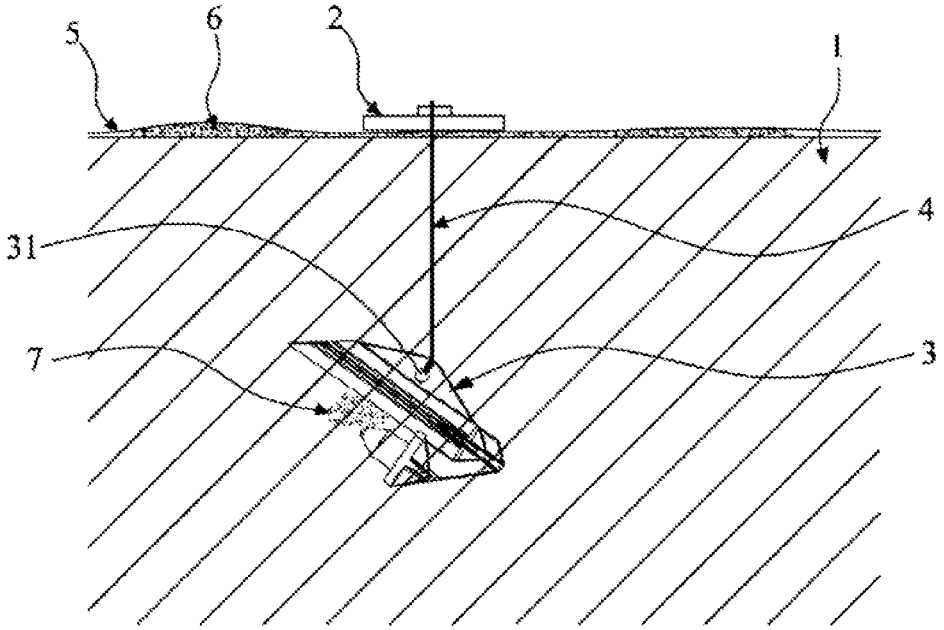
FIG. 2 schematically shows a state where the positioning member of FIG. 1 has been rotated and the greening member is fastened by the positioning cover.
Figure 3:
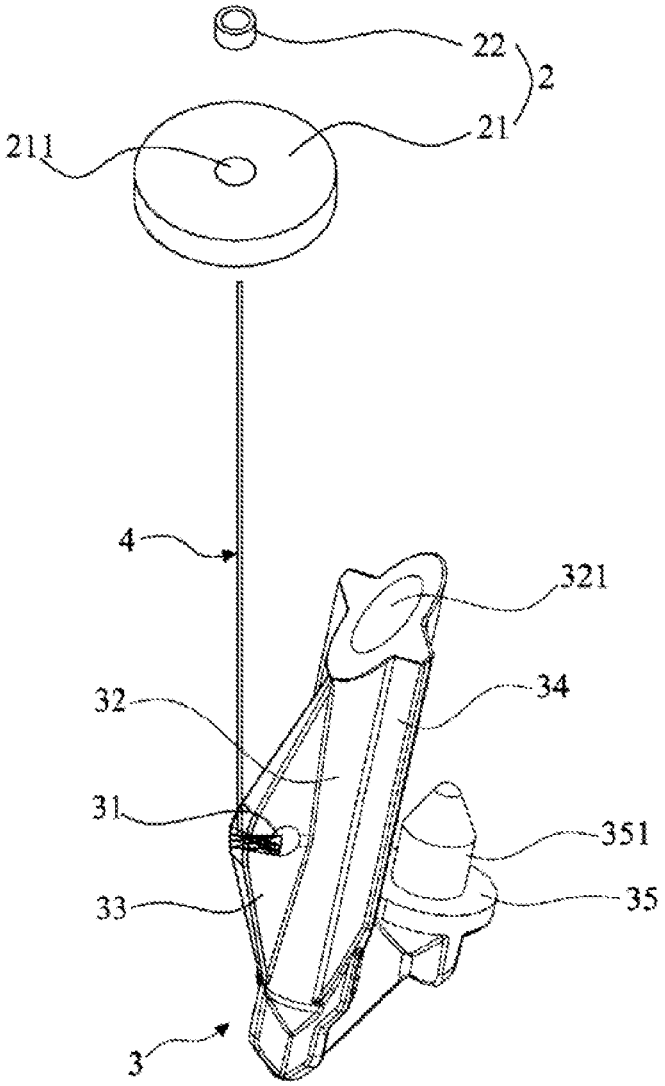
FIG. 3 schematically shows an exploded view of the positioning member, the rope and the positioning cover of the invention.

With reference to FIGS. 1-3, a reinforcing structure for fastening a net or an ecological fabric (i.e. a greening member), that may be applicable to a soil area 1 to be afforested, is shown. The reinforcing structure includes: a greening net or ecological fabric 5 for being placed on a surface of the area 1 to be afforested, and the greening net or ecological fabric 5 may be placed after greening materials 6 (e.g. plant growing materials, water absorbent materials) are placed on the surface of the area 1 for the purpose of planting, or the greening materials 6 may be placed on the greening net or ecological fabric 5 for the purpose of planting; a positioning cover 2 adapted pressing on the greening net or ecological fabric 5 to prevent displacement thereof; a positioning member 3 provided with a pivot portion 31, which is adapted for being inserted into the ground of the area 1 to be afforested; a rope 4, one end of which is fastened to the pivot portion 31, and the other end of which is extended out from the ground of the area 1 and extended through the greening net or ecological fabric 5 to the positioning cover 2, where the other end of the rope 4 is fixed by the positioning cover 2, so that the rope 4 is tensioned between the positioning cover 2 and the positioning member 3, with the positioning cover 2 pressing on the greening net or ecological fabric 5, here the rope 4 may be made from steel, iron or plastic.

The positioning cover 2 may include a cover body 21 and a locking sleeve 22, the cover body may be provided with a through hold 211, the locking sleeve 22 may be made of metal and rest against the periphery of the through hole 211, and the rope 4 is extended through the through hole 211 and into the locking sleeve 22, and then locked by the locking sleeve 22 that is deformed.

The positioning member 3 may be of a column-like shape and made of metal or plastic. The positioning member 3 may include a positioning body 32 which is provided with a longitudinal aperture 321, into which a tool may be inserted to press the positioning member 3 into the ground of the area 1 to be afforested. The pivot portion 31 is arranged on the periphery of the positioning body 32, that is, a longitudinal ridge 33 is extended from the periphery of the positioning body 32, and the longitudinal ridge 33 is provided with a through hole, which functions as the pivot portion 31 and to which one end of the rope 4 is fastened. A pair of lateral wings 34, which are relatively narrow, are symmetrically provided at both lateral sides of the positioning body 32, so that the positioning member 3 will be subjected to effectively increased resistance after being rotated in the area 1 to be afforested. A reinforcing layer 7 adhering to the positioning member 3 is provided between the positioning member 3 and the surface of the area 1 for afforesting. The reinforcing layer 7 may be formed of adhesive or cement. For the sake of injecting the adhesive or cement, a platform 35 may be provided at the periphery of the positioning body 32 of the positioning member 3, and a cone-shaped stopper 351 is longitudinally provided on the platform 35 upwards, to plug the hollow pipe 8 for injecting the adhesive or cement, so that earth will not enter into the hollow pipe 8 when the positioning member 3 is being inserted into the ground.

In use, one end of the rope 4 is fastened to the pivot portion 31 of the positioning member 3, then the positioning member 3 is inserted forcedly into the ground of the area 1 for greening to a predetermined depth through a tool such as a vibrator. At this time, a portion of the rope 4 is extended into the ground of the area 1 along with the positioning member 3, but a portion of the rope 4 is still exposed above the ground. Then, the rope 4 is drawn outwards (e. g. by means of a certain tool) to cause the positioning member 3 to rotate about the pivot portion 31 by a certain degree under the ground of the area 1, so that the positioning member 3 will be subjected to a large resistance by the ground of the area 1. Then, the greening net or ecological fabric 5 is placed on the surface of the area 1 for afforesting, the portion of the rope 4 that is exposed above the ground of the area 1 for afforesting is extended through the greening net or ecological fabric 5, then the positioning cover 2 is pressed on the greening net or ecological fabric 5, and the exposed portion of the rope 4 is extended through and fixed to the positioning cover 2, so that the rope 4 is tightly tensioned between the positioning cover 2 and the positioning member 3. Thus, the positioning cover 4 is tightly pressed against the greening net or ecological fabric 5, which may be hence fixed stably on the surface of the area 1 for afforesting. For the purpose of injecting the adhesive or cement to form the reinforcing layer 7, the hollow pipe 8 for injecting the adhesive or cement is connected to the tool such as a vibrator, and one end of the hollow pipe 8 is blocked by the stopper 351. When the positioning member 3 is inserted into the ground of the area 1 by a certain tool, a portion of the pipe 8 is also extended into the ground along with the tool. Subsequently, the tool as well as the hollow pipe 8 is drawn back by a certain distance so that the pipe 8 is separated from the stopper 351 of the positioning member 3 by a certain gap, and then the adhesive or cement is injected through the pipe 8 and penetrates the ground of the area for afforesting. Further, the rope 4 is drawn outwards. After the adhesive is solidified, a reinforcing layer 7 is formed between the positioning member 3 and the area 1 for afforesting, to achieve a better effect of fastening. Alternatively, the adhesive may be injected through the pipe 8 during or after the rotation of the positioning member 3.

Figure 4:
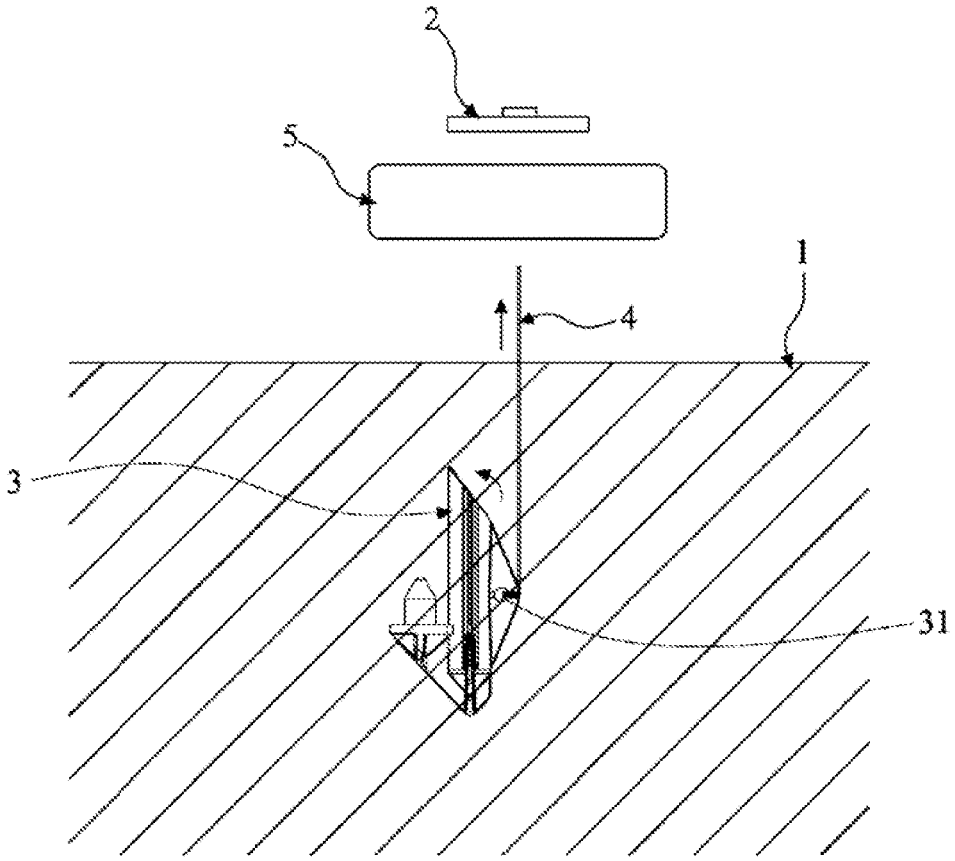
FIG. 4 schematically shows a second embodiment of the invention, which may be applicable to a soil area to be afforested, in a state where the positioning member is inserted into the ground of the area for fastening a greening member such as an vegetation bag.
Figure 5:
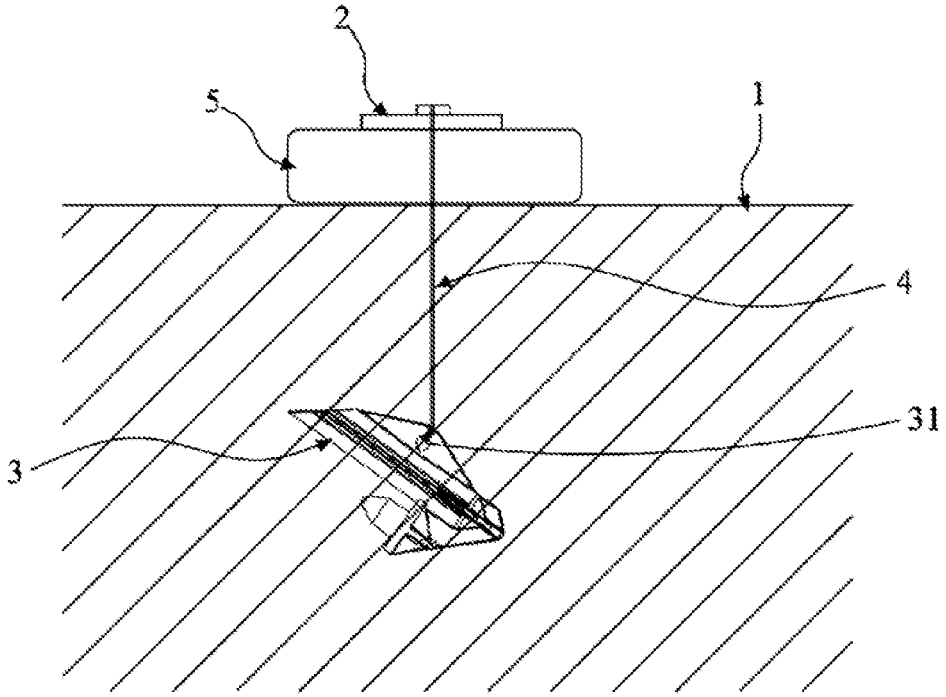
FIG. 5 schematically shows a state where the positioning member of FIG. 4 has been rotated.

FIGS. 4-5 show a second embodiment of the present invention applicable to a soil area 1 for afforesting. The second embodiment is different from the first embodiment in that the greening member is a vegetation bag 5 other than the greening net or fabric. The vegetation bag may be filled with plant growing materials for planting. The other parts including the positioning cover 2, the positioning member 3, the pivot portion 31, the rope 4, and so on and the construction method thereof are the same as in the first embodiment, and detailed description is omitted.

Figure 6:
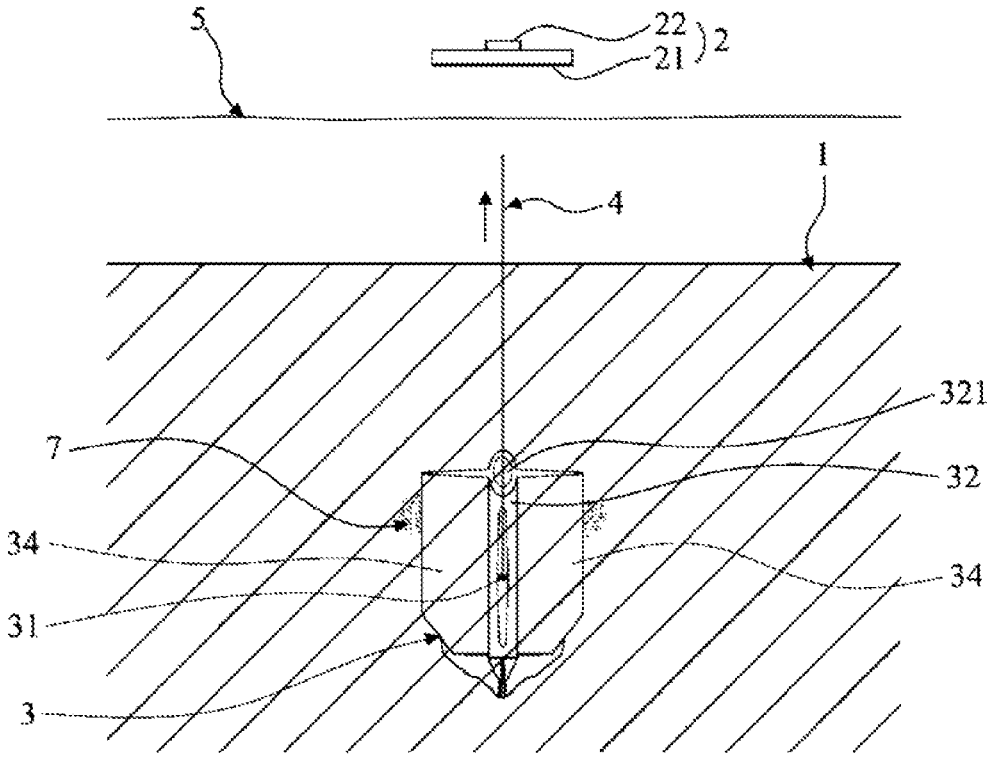
FIG. 6 schematically shows a third embodiment of the invention, which may be applicable to a sand or soil area, to be afforested, in a state where the positioning member is inserted into the ground of the area for fastening a greening member such as an ecological fabric.
Figure 7:
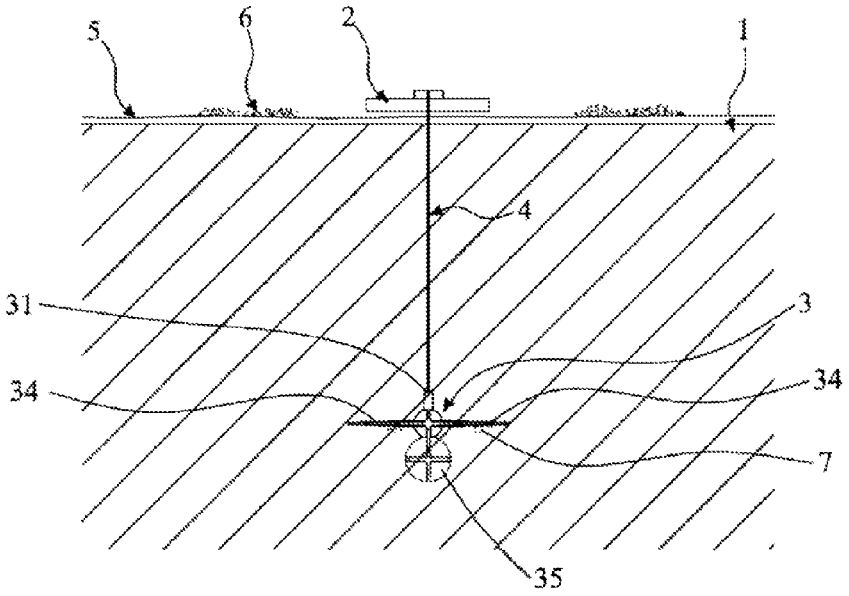
FIG. 7 schematically shows a state where the positioning member of FIG. 6 has been rotated and the greening member is fastened by the positioning cover.
Figure 8:
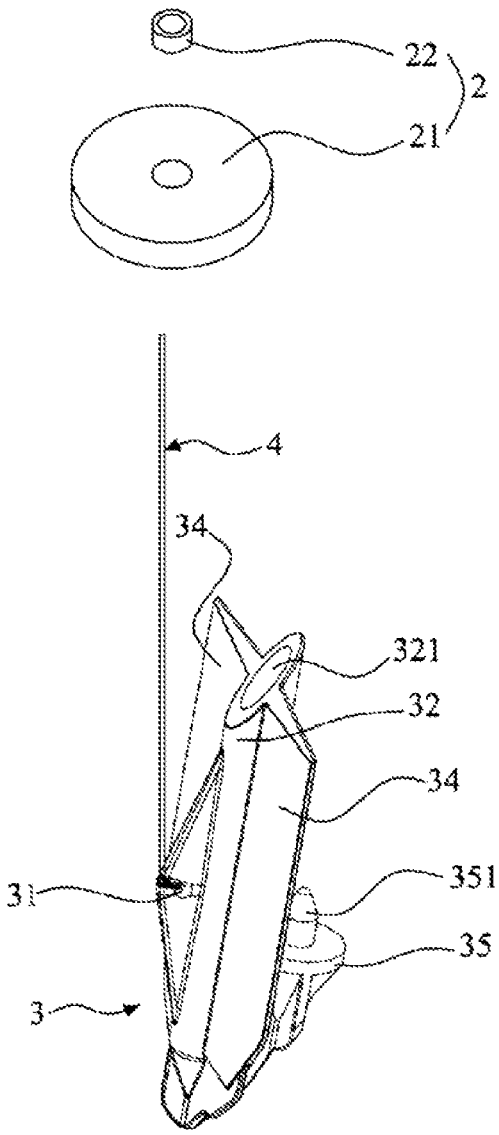
FIG. 8 schematically shows an exploded view of the positioning member, the rope and the positioning cover of the third embodiment of the invention.

The embodiment shown in FIGS. 6-8 may be applicable to a sand area 1 for afforesting (e. g. a desert), to fasten greening members such as an ecological fabric or a greening net 5. Considering that the sand area is relatively soft, the pair of lateral wings 34 symmetrically provided at both lateral sides of the positioning body 32 are shaped as thin plates with a large area, for the ease of rotating in the sand area. In this case, one end of the rope 4 is fastened to the pivot portion 31 of the positioning member 3, then the positioning member 3 is inserted forcedly into the ground of the area 1 for afforesting, and then the rope 4 is drawn upwards to cause the positioning member 3 to rotate horizontally, until the lateral wings 34 are arranged horizontally. As a result, the area of the entire plate-shaped lateral wings 34 serves as the resistance area, and the resistance applied to the positioning member 3 under the ground of the area 1 is effectively increased. The other aspects of the present embodiment, such as the positioning cover 2 including the cover body 2 and the locking sleeve 22, the positioning member 3 including a positioning body 32 in which a longitudinal aperture 321 is provided, the platform 35 and the cone-shaped stopper 351 on the platform that are arranged at the side of the positioning member 3, and the method of injecting the adhesive through the hollow pipe to form the reinforcing layer 7, are the same as those of the previous embodiments. It will be appreciated that the ecological fabric or greening net 5 may be replaced by vegetation bags.

As can be seen from the above embodiment, different positioning members may be selected depending on the types of the areas for afforesting. The positioning member may be pressed forcedly into the ground of the afforesting area, and then caused to rotate under the ground by the pulling of the rope, so that the positioning member would be subjected to an increased resistance in the ground of the afforesting area, thus the positioning member is not easy to be pulled out from the ground. Further, the rope is fastened to the positioning cover, to cause the positioning cover to firmly press the greening member. The positioning member which is firmly held under the ground of the afforesting area will not be loosened, thus the greening member can be firmly located on the surface of the afforesting area, to overcome the drawback of the traditional anchor rod.

The preferable embodiments of the present invention are illustrated, but not intended to limit the invention. It will be appreciated by those skilled in the art that the present invention can be variously modified and changed. Any modifications, equivalent substitutions, improvements, etc., which is not departed from the spirit and principle of the present invention, should fall within the scope of the present invention.

What is claimed is:

1. A structure for reinforcing a greening member adapted for being placed on a surface of an afforesting area, comprising:

a positioning cover adapted for pressing on the greening member;

a positioning member provided with a pivot portion, which is adapted for being inserted into the afforesting area; and a rope, one end of which is fastened to the pivot portion, and the other end of which is extended out from the afforesting area and extended through the greening member to the positioning cover, where the other end of the rope is fixed by the positioning cover, so that the rope is tensioned between the positioning cover and the positioning member, with the positioning cover pressing on the greening member;

wherein the positioning member comprises a positioning body which is provided with a longitudinal aperture, and the pivot portion is arranged on the periphery of the positioning body, a pair of lateral wings are symmetrically provided at both lateral sides of the positioning body.

2. The structure of claim 1, wherein the positioning cover comprises a cover body and a locking sleeve, the cover body is provided with a through hole, the locking sleeve rests against a periphery of the through hole of the cover body, and the rope is extended through the hole and locked by the locking sleeve.

3. The structure of claim 1, wherein a longitudinal ridge is extended from the periphery of the positioning body, and the longitudinal ridge is provided with a through hole, which functions as the pivot portion and to which one end of the rope is fastened.

4. The structure of claim 1, wherein a platform is provided at the periphery of the positioning body, and a cone-shaped stopper is longitudinally provided on the platform upwards.

5. The structure of claim 4, wherein a reinforcing layer adhering to the positioning member is provided between the positioning member and the surface of the afforesting area.

6. The structure of claim 1, wherein the greening member is an ecological fabric, an ecological bag, a planting bag, or a greening grid; the positioning member is made of metal or plastic; and the rope is a steel wire, an iron wire or a plastic rope.

7. A method for constructing the structure for reinforcing a greening member of claim 1, comprising steps of:

fastening one end of the rope to the pivot portion of the positioning member;

inserting the positioning member into an afforesting area by a predetermined depth through a tool, with the rope being partially extended to the afforesting area along with the positioning member, and a portion of the rope being extended out from the area;

pulling the rope outwards so that the positioning member is rotated about the pivot portion in the area by an angle;

placing the greening member on the surface of the afforesting area; and passing the portion of the rope extended out from the area through the greening member and fastening the portion of the rope to the positioning cover, so that the rope is tensioned between the positioning cover and the positioning member, with the positioning cover pressing on the greening member, allowing the greening member to be fixed on the surface of the afforesting area, when the positioning member is inserted into the afforesting area by a tool, a hollow pipe is partially extended into the afforesting area along with the tool, and then the tool is drawn back by a distance so that the hollow pipe is separated from the stopper of the positioning member; then the rope is drawn outwards, and in the process of rotating the positioning member or when the rotating of the positioning member is stopped, adhesive is injected into the hollow pipe and penetrates the afforesting area, so that a reinforcing layer adhering to the positioning member is formed from the solidification of the adhesive between the positioning member and the afforesting area.

* * * * *